United States Patent [19]

Maniscalco

[11] Patent Number: 4,590,644

[45] Date of Patent: May 27, 1986

[54] CLAM OPENER

[76] Inventor: Nunzio T. Maniscalco, 4223 Madison Ave., Trumbull, Conn. 06611

[21] Appl. No.: 739,464

[22] Filed: May 29, 1985

[51] Int. Cl.[4] ..... A22C 29/00

[52] U.S. Cl. ..... 17/76

[58] Field of Search ..... 17/70, 74, 75, 76

[56] References Cited

U.S. PATENT DOCUMENTS 1,499,965 7/1924 Beyerle ..... 17/76

1,510,313 9/1924 Dickerson ..... 17/76

*Primary Examiner*—Willie G. Abercrombie

[57] ABSTRACT

A clam opener comprises a pair of holders firmly gripping a clam, and a pivotally mounted knife for forcing the clam shells apart and opening the clam.

2 Claims, 5 Drawing Figures

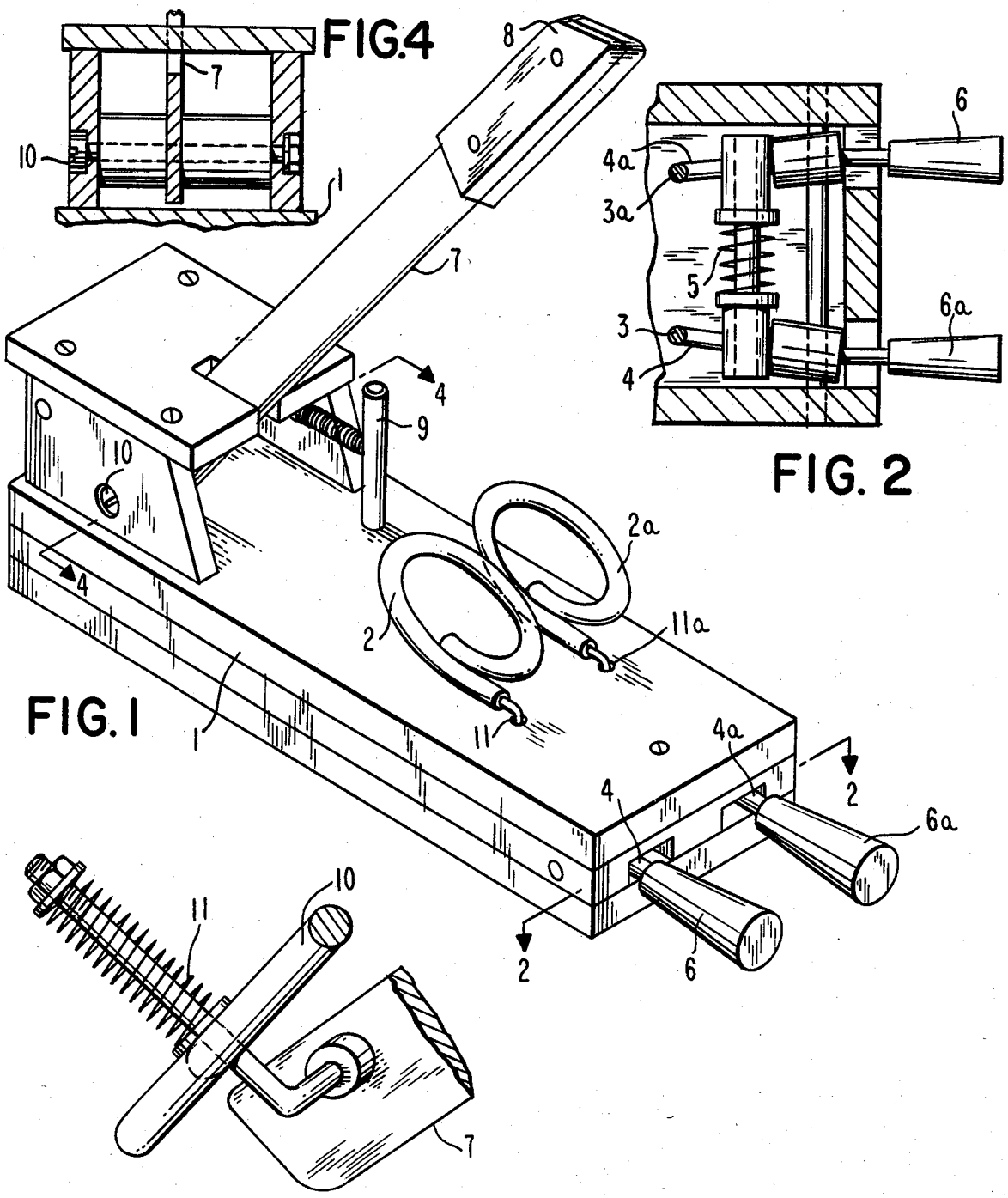
FIG. 2
FIG. 1
FIG. 3
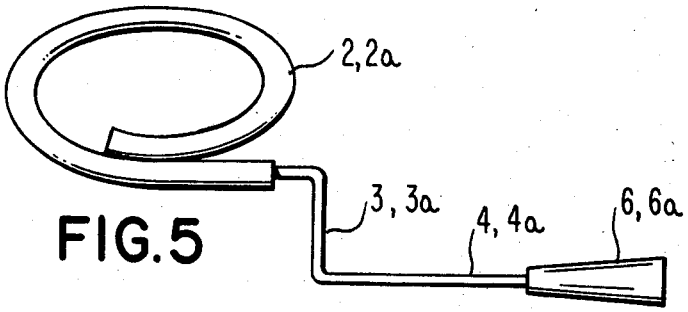
FIG.5

CLAM OPENER

BACKGROUND OF THE INVENTION

1. Field of the Invention

This invention relates to a clam opener. In particular, it provides a device for holding clams and a knife for opening them.

2. Description of Prior Art

Clam openers commercially available suffer from the drawbacks that they do not hold the clam during opening, that their knives are difficult to operate, and that they may be unsafe for the user.

SUMMARY OF THE INVENTION

Therefore, there is a need for a safe and efficient device for opening clams.

BRIEF DESCRIPTION OF THE DRAWINGS

FIG. 1 is a perspective view of a clam opener shown in accordance with the present invention;

FIG. 2 is a cross-sectional view taken along line 2—2 of FIG. 1;

FIG. 3 is a fragmentary view of the blade spring tension device;

FIG. 4 is a cross-section view taken along line 4—4 of FIG. 1, and

FIG. 5 is a side elevational view of a typical clam holder shown in the embodiment of the invention.

DETAILED DESCRIPTION

Referring to the drawing, FIG. 1 shows a base 1. A pair of holders 2 and 2*a* preferably made of heavy steel wire and covered with rubber or plastic tubing, parallel to each other, projects from the base. The holders are pivoted on extensions 3 and 3*a*, which pass through openings 11 and 11*a* in base 1. Extensions 3 and 3*a* are connected at right angles to arms 4 and 4*a*, which are forced apart by spring 5 in the vicinity of handles 6 and 6*a* in such manner as to impart an inward force to holders 2 and 2*a*. Handles 6 and 6*a*, mounted at the ends of arms 4 and 4*a* enable the user to compress spring 5, force holders 2 and 2*a* apart, insert a clam between the holders, and release handles 6 and 6*a*, thereby causing the holders to clasp the clam firmly.

At the end of base 1 opposite the holders 2 and 2*a*, there is provided a knife blade 7 pivotally attached to a knife support 10. At the end of knife blade 7, there is provided a handle 8.

When a clam has been placed between the holders 2 and 2*a*, knife blade 7 is lowered onto the crack between the clam shells and pressed downward, whereby the clam shells are forced apart.

The knife blade 7 is biased by spring 11 to remain in a raised position, but may be latched in the lowered position by lock means 9, when the clam opener is not in use.

While various changes may be made in the detail construction, it is understood that such changes will be within the spirit and scope of the present invention, as is defined by the appended claims.

What I now claim is:

1. A clam opener having a base, a pair of holders with extensions pivoting in openings in said base, said extensions being integrally connected at right angles to arms longitudinally disposed under said base, said arms being forced apart by a spring, thereby imparting an inward force to said holders for firmly grasping a clam placed therebetween, and a knife blade pivotally connected to a knife support for opening the clam.

2. A clam opener in accordance with claim 1 wherein said knife blade is spring biased to remain in a raised position.

* * * * *